US008863539B2

(12) United States Patent
Tsuruma

(10) Patent No.: US 8,863,539 B2
(45) Date of Patent: Oct. 21, 2014

(54) CONTROL APPARATUS AND REFRIGERATING APPARATUS

(75) Inventor: Ryuichi Tsuruma, Gunma-ken (JP)

(73) Assignee: Panasonic Healthcare Co., Ltd., Ehime (JP)

( * ) Notice: Subject to any disclaimer, the term of this patent is extended or adjusted under 35 U.S.C. 154(b) by 501 days.

(21) Appl. No.: 13/339,013

(22) Filed: Dec. 28, 2011

(65) Prior Publication Data

US 2013/0000330 A1 Jan. 3, 2013

(30) Foreign Application Priority Data

Dec. 28, 2010 (JP) ..... 2010-293582

(51) Int. Cl.
*F25B 49/02* (2006.01)
*H02H 3/00* (2006.01)
*H02H 3/24* (2006.01)

(52) U.S. Cl.
USPC ..... 62/230; 361/92

(58) Field of Classification Search
CPC .. F25D 29/00; F25B 2700/00; F25B 2700/15; F25B 2700/151; F25B 49/025; H02H 3/00; H02H 3/08; H02H 3/24; H02H 9/02
USPC ..... 62/126, 228.1, 228.3, 230; 361/63, 79, 361/86, 87, 92, 93.1
See application file for complete search history.

(56) References Cited

U.S. PATENT DOCUMENTS 4,084,406 A * 4/1978 Brenneman ..... 62/211
6,760,207 B2 * 7/2004 Wyatt et al. ..... 361/93.1
7,164,242 B2 * 1/2007 Federman et al. ..... 318/400.21
7,352,545 B2 * 4/2008 Wyatt et al. ..... 361/31

FOREIGN PATENT DOCUMENTS

JP 62-225854 A 10/1987
JP 07-120045 A 5/1995
JP 09-149547 A 6/1997
JP 11-045370 A 2/1999
JP 2001-304651 A 10/2001
JP 2003-274552 A 9/2003
JP 2006-068122 A 3/2006
JP 2010-051156 A 3/2010
JP 2010-065925 A 3/2010

OTHER PUBLICATIONS

Japanese Office Action issued in corresponding Japanese Application No. 2010-293582, dated Feb. 18, 2014.
English translation of Japanese Publication No. 2010-065925 Published Mar. 25, 2010, original Foreign document submitted Dec. 28, 2012 (14 pages).
English translation for Japanese Publication No. 2006-068122 Published Mar. 16, 2006, original Foreign document submitted on Dec. 28, 2011 (11 pages).

* cited by examiner

*Primary Examiner* — Marc Norman
(74) *Attorney, Agent, or Firm* — McDermott Will & Emery LLP

(57) ABSTRACT

A control apparatus, which controls a refrigerating apparatus including a compressor and a first circuit breaker that interrupts a current flowing through the compressor when the current, flowing from a power supply through the compressor to cause the compressor to work, becomes greater than a predetermined current and that is closed according to an operation by a user, includes: a voltage-measuring unit to measure a power-supply voltage a control unit to trip a second circuit breaker disposed in series with the first circuit breaker so that the current from the power supply flowing through the compressor is interrupted, when the measured power-supply voltage becomes lower than a predetermined voltage, and close the second circuit breaker after the power-supply voltage becomes higher than the predetermined voltage, the predetermined current corresponding to a current greater than the current flowing through the compressor when the power-supply voltage is equal to the predetermined voltage.

7 Claims, 4 Drawing Sheets

CONTROL APPARATUS AND REFRIGERATING APPARATUS

CROSS-REFERENCE TO RELATED APPLICATION

This application claims the benefit of priority to Japanese Patent Application No. 2010-293582, filed Dec. 28, 2010, of which full contents are incorporated herein by reference.

BACKGROUND OF THE INVENTION

1. Field of the Invention

The present invention relates to a control apparatus and a refrigerating apparatus.

2. Description of the Related Art

A compressor provided in a refrigerating apparatus may lock due to some abnormalities such as overheating and a slow leak of a refrigerant. When the compressor locks an overcurrent flows, and if such a situation is left as it is, then a coil of the compressor motor burns out, leading to destruction of the compressor. Thus, a common refrigerating apparatus includes a protection circuit (e.g., overload relay of bimetal, etc.) to protect the compressor against overcurrent or overheating. It is desirable that the abnormality causing locking of the compressor is resolved within a Short time, but if the abnormality continues for a long time, the protection circuit is turned on and off repeatedly, possibly resulting in welding of the bimetal in the worst case.

On the other hand, in a so-called ultracold freezer configured to contain biotic samples and cool an inside of the freezer to a temperature lower than or equal to −80° C., if cooling capacity is lost due to problems such as locking of the compressor, precious biotic samples contained therein is damaged. Thus, there is one that is doubly provided with freezing circuits to prevent such an damage, so that even if one freezing circuit (e.g., compressor) fails, the other remaining freezing circuit will secure the cooling capacity, thereby avoiding the frozen samples from being thawed (Japanese Laid-Open Patent Publications Nos. 2006-68122 and 2010-65925).

If the locking of the compressor results in the welding of the bimetal, an overcurrent continues to flow, and therefore a circuit breaker (so-called breaker) that protects a system as a whole is operated. In the apparatus doubly provided with freezing circuits described above, in order to prevent the whole system from getting down due to the locking of the compressor in the one freezing circuit, an individual circuit breaker is further provided, in series with the overload relay, for each of the two freezing circuits. Such an individual circuit breaker is realized by employing a manual-reset-type circuit breaker so as to prevent re-welding, as well as by being set such that the circuit breaker is operated before a main circuit breaker, which protects the whole system, is operated.

Incidentally, when a power supply voltage fluctuates, a voltage drop may cause the compressor to lock. An overcurrent flows in this case as well, however, if the individual circuit breaker of the manual-reset-type is operated at this moment, the freezing circuit remains at rest even after voltage recovery unless a user resets the circuit breaker, which prevents the initial freezing capacity from being used.

SUMMARY OF THE INVENTION

A control apparatus according to an aspect of the present invention, which is configured to control a refrigerating apparatus including a compressor and a first circuit breaker, the first circuit breaker configured to interrupt a current flowing through the compressor when the current becomes greater than a predetermined current and configured to be closed in response to an operation by a user, the current flowing from a power supply through the compressor to cause the compressor to work, the control apparatus includes: a voltage measuring unit configured to measure a voltage of the power supply; and a control unit configured to trip a second circuit breaker disposed in series with the first circuit breaker so that the current from the power supply flowing through the compressor is interrupted, when the measured voltage of the power supply becomes lower than a predetermined voltage, and close the second circuit breaker after the voltage of the power supply becomes higher than the predetermined voltage, the predetermined current corresponding to a current greater than the current flowing through the compressor when the voltage of the power supply is equal to the predetermined voltage.

Other features of the present invention will become apparent from descriptions of this specification and of the accompanying drawings.

BRIEF DESCRIPTION OF THE DRAWINGS

For more thorough understanding of the present invention and advantages thereof, the following description should be read in conjunction with the accompanying drawings, in which.

DETAILED DESCRIPTION OF THE INVENTION

At least the following details will become apparent from descriptions of this specification and of the accompanying drawings.

Figure 1:
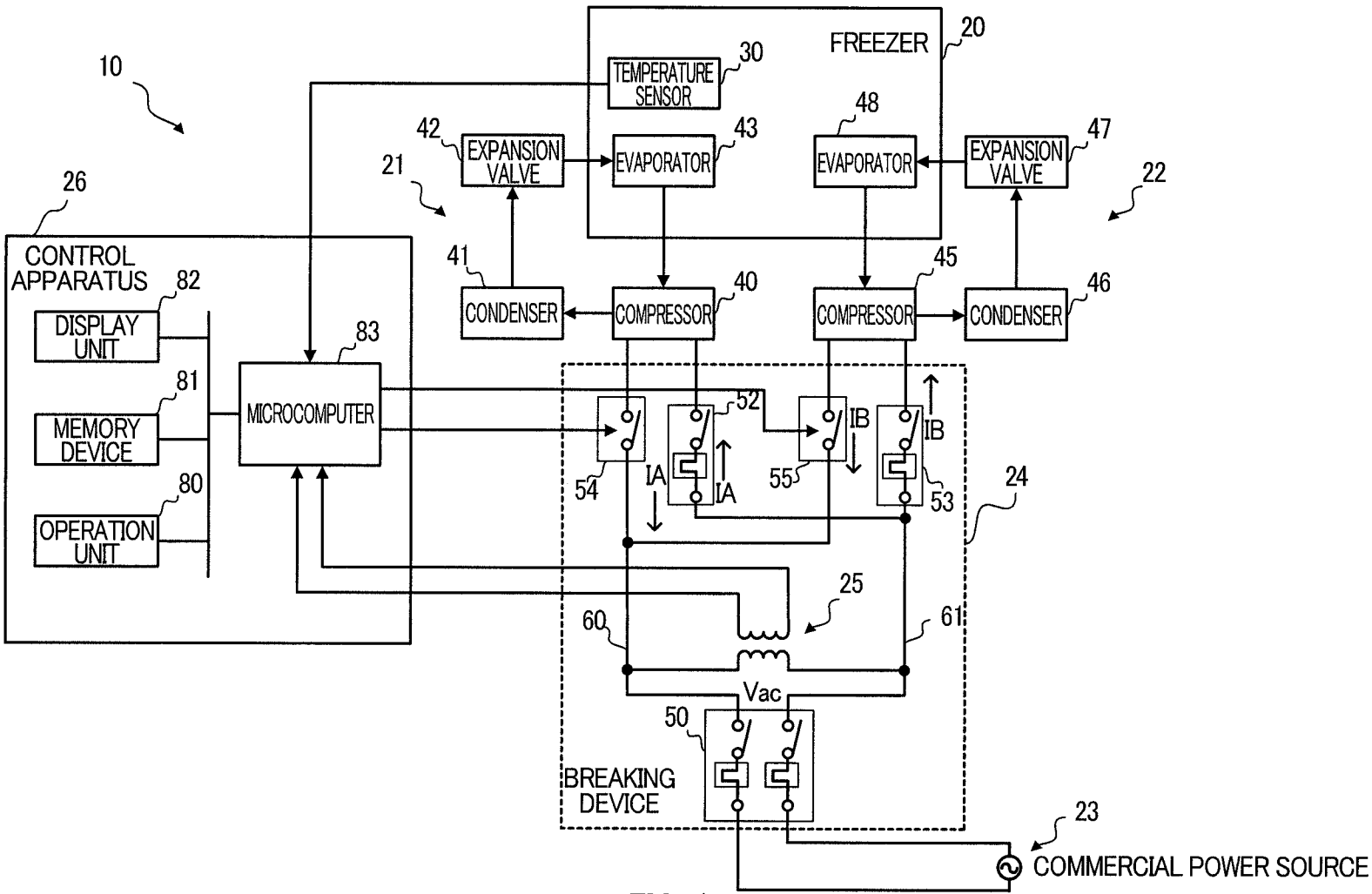
FIG. 1 is a diagram illustrating a configuration of a refrigerating apparatus 10 according to an embodiment of the present invention.

FIG. 1 depicts a configuration of a refrigerating apparatus 10 according to an embodiment of the present invention. The refrigerating apparatus 10 includes a freezer 20, refrigerant circuits 21 and 22, a commercial power supply 23, a breaking device 24, a transformer 25, and a control apparatus 26.

The freezer 20 stores frozen items, body tissues, etc., at an ultralow temperature of −80° C., for example. The freezer 20 includes a temperature sensor 30 configured to output a voltage corresponding to a temperature inside the freezer.

The refrigerant circuit 21 is a circuit configured to cool an inside of the freezer 20, and includes a compressor 40, a condenser 41, an expansion valve 42, and an evaporator 43.

The compressor 40 (first compressor) is configured to suck refrigerant evaporated by the evaporator 43, and thereafter compress the refrigerant to be discharged to the condenser 41. The compressor 40 includes a motor (not shown) configured to cause the compressor 40 to work when supplied with power.

The condenser 41 is configured to cool and liquefy the high-temperature, high-pressure, gaseous refrigerant compressed by the compressor 40.

The expansion valve 42 is configured to gasify the high-pressure refrigerant liquefied by the condenser 41 and output the gasified refrigerant to the evaporator 43. The evaporator 43 is configured to evaporate the refrigerant to cool the inside of the freezer 20.

Similarly to the refrigerant circuit 21, the refrigerant circuit 22 is a circuit configured to cool the inside of the freezer 20, and includes a compressor 45 (second compressor), a condenser 46, an expansion valve 47, and an evaporator 48. Since blocks of the refrigerant circuit 22 is the same as those of the refrigerant circuit 21, detailed description thereof is omitted.

The commercial power supply 23 is a power supply to supply power to the refrigerating apparatus 10, and is connected to an outlet (not shown) of the commercial power supply 23. It should be noted that the commercial power supply 23 is supplied to the control apparatus 26 as well, which is omitted in FIG. 1.

The breaking device 24 is configured to interrupt the current supplied from the commercial power supply 23 to the compressors 40 and 45 to cause the compressors 40 and 45 to stop working when the temperature inside the freezer 20 has reached a predetermined temperature or an overcurrent occurs in the compressors 40 and 45, for example. The breaking device 24 is provided between the commercial power supply 23 and the compressors 40 and 45, and includes circuit breakers 50 and 52 to 55 and cables 60 and 61.

The circuit breaker 50 is a main circuit breaker and is configured to interrupt the current supplied to the compressors 40 and 45 when the current supplied from the commercial power supply 23 to the compressors 40 and 45 reaches an overcurrent level.

A power supply voltage is applied to the compressor 40 via the cable 60 and the circuit breaker 54 and the cable 61 and the circuit breaker 52, as well as is applied to the compressor 45 via the cable 60 and the circuit breaker 55 and the cable 61 and the circuit breaker 53.

It is assumed in an embodiment of the present invention that the circuit breaker 50 is tripped when the current flowing through the circuit breaker 50 has reached a predetermined current I0.

The circuit breaker 52 (first circuit breaker) is a circuit breaker configured to protect the compressor 40 against an overcurrent, and interrupt a current IA flowing through the compressor 40 when the current IA has reached a predetermined current I1 (first current) indicative of an overcurrent. The predetermined current I1 is set to be smaller than (e.g., a half of) the predetermined current I0.

The circuit breaker 53 (second circuit breaker) is a circuit breaker configured to protect the compressor 45 against an overcurrent, and interrupt a current IB flowing to the compressor 45 when the current IB has reached the predetermined current I1 (second current) indicative of an overcurrent.

The circuit breakers 50 and 52 to 53 are manual-reset-type circuit breakers each configured to be reset by an operation by a user after having been activated.

The circuit breaker 54 (third circuit breaker) is a so-called temperature control relay to be operated by the control apparatus 26, and is configured to be tripped by the control apparatus 26 when the temperature inside the freezer 20 has reached a predetermined temperature or a power supply voltage Vac becomes lower than a predetermined voltage V1 (e.g., 70% of the power supply voltage Vac).

The circuit breaker 55 (fourth circuit breaker) is the so-called temperature control relay to be operated by the control apparatus 26, and is configured to be tripped by the control apparatus 26 when the temperature inside the freezer 20 has reached the predetermined temperature or the power supply voltage Vac becomes lower than the predetermined voltage V1. In an embodiment of the present invention, the predetermined voltage V1 is determined such that the currents IA and IB when the power supply voltage Vac reaches the predetermined voltage V1 are smaller than the predetermined current I1 indicative of an overcurrent.

Thus, when the power supply voltage Vac becomes lower than the predetermined voltage V1, the circuit breaker 54 is tripped before the current IA reaches an overcurrent level, namely, before the circuit breaker 52 is tipped. Similarly, when the power supply voltage Vac becomes lower than the predetermined voltage V1, the circuit breaker 55 is tripped before the current IB reaches an overcurrent level, namely, before the circuit breaker 53 is tipped. Here, each of the currents IA and IB when the power supply voltage Vac becomes the predetermined voltage V1 is referred to as a current I2 (<I1).

The transformer 25 is a so-called measuring transformer configured to step down the power supply voltage Vac with a predetermined rate.

The control apparatus 26 is an apparatus configured to control the operation of the refrigerating apparatus 10 in an integral manner based on outputs from the transformer 25 and the temperature sensor 30, and includes an operation unit 80, a memory device 81, a display unit 82, and a microcomputer 83.

The operation unit 80 is an operation panel, etc., for setting the operation of the refrigerating apparatus 10 by a user. Results of the operation in the operation unit 80 are sent to the microcomputer 83, for example.

The memory device 81 is configured to store program data to be executed by the microcomputer 83 and other various data.

The display unit 82 is a display panel, etc., for displaying various information such as the temperature inside the freezer 20, results of operation, presence/absence of abnormality in the refrigerating apparatus 10.

The microcomputer 83 is configured to realize various functions by executing the program data stored in the memory device 81. For example, when the temperature inside the freezer 20 is set by a user, the microcomputer 83 executes a program for bringing the temperature inside the freezer 20 to the set temperature, and controls the blocks in the refrigerating apparatus 10.

<Details of Microcomputer 83>

Figure 2:
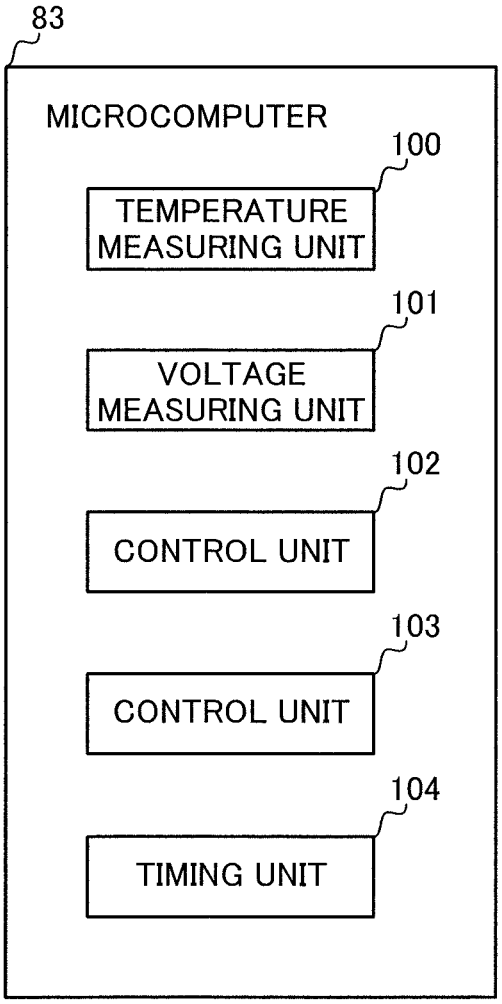
FIG. 2 is a diagram illustrating a functional block to be implemented by a microcomputer 83.

The microcomputer 83 realizes functions of a temperature measuring unit 100, a voltage measuring unit 101, control units 102 and 103, and a timing unit 104 as illustrated in FIG. 2, for example, when executing the program for bring the temperature inside the freezer 20 to the set temperature.

The temperature measuring unit 100 is configured to measure the temperature inside the freezer 20 based on the output from the temperature sensor 30. Further, the temperature measuring unit 100 is configured to display the measured temperature on the display unit 82.

The voltage measuring unit 101 is configured to measure the power supply voltage Vac based on the voltage transformed by the transformer 25. Since the power supply voltage Vac is an AC voltage, the voltage measuring unit 101 is configured to measure the effective value, for example, of the power supply voltage Vac.

The control unit 102 is configured to control the circuit breakers 54 and 55 so that the measured temperature inside the freezer 20 reaches the set temperature. When the temperature inside the freezer 20 reaches a predetermined temperature Ta (e.g., −82° C.) that is lower than the set temperature (e.g., −80° C.), the control unit 102 trip the circuit breakers 54 and 55 to cause the compressors 40 and 45 to stop working. When the temperature inside the freezer 20 reaches a predetermined temperature Tb (e.g., −78° C.) that is higher than the set temperature after a predetermined time T1 has elapsed from the tripping of the circuit breakers 54 and 55, the control unit 102 closes (connects) the circuit breakers 54 and 55 in a sequential manner to cause the compressors 40 and 45 to start working. Thus, the temperature inside the freezer 20 can be maintained approximately at the set temperature. The predetermined time T1 corresponds to a time for the pressure of a refrigerant on a suction side of the compressor 40 and the pressure of the refrigerant on a discharge side thereof to reach equilibrium (e.g., three minutes), for example. The predetermined temperature Ta corresponds to a first temperature, and the predetermined temperature Tb corresponds to a second temperature.

The control unit 103 is configured to control the circuit breakers 54 and 55 based on the magnitude of the measured power supply voltage Vac and the predetermined voltage V1, namely, the magnitude of the effective value of the power supply voltage Vac and the effective value of the predetermined voltage V1. When the power supply voltage Vac becomes lower than the predetermined voltage V1, the control unit 103 trips (i.e., turns off) the circuit breakers 54 and 55 to cause the compressors 40 and 45 to stop working. When the power supply voltage Vac becomes higher than the predetermined voltage V1 after the predetermined time T1 has elapsed from the tripping of the circuit breakers 54 and 55, the control unit 103 closes the circuit breakers 54 and 55 in a sequential manner. Further, when the power supply voltage Vac becomes lower than the predetermined voltage V1 and the circuit breakers 54 and 55 are tripped, the control unit 103 causes the display unit 82 to display stop information indicating that the compressors 40 and 45 have stopped working due to a voltage drop.

The timing unit 104 is configured to time with respect to the predetermined time T1 that is a time after the tripping of the circuit breakers 54 and 55 and a predetermined time T2 that is a time after the closing of the circuit breaker 54. The predetermined time T2 is the time (e.g., one minute) provided to avoid the concurrent activation of the compressors 40 and 45.

<Example of Processing of Microcomputer 83>

Figure 3:
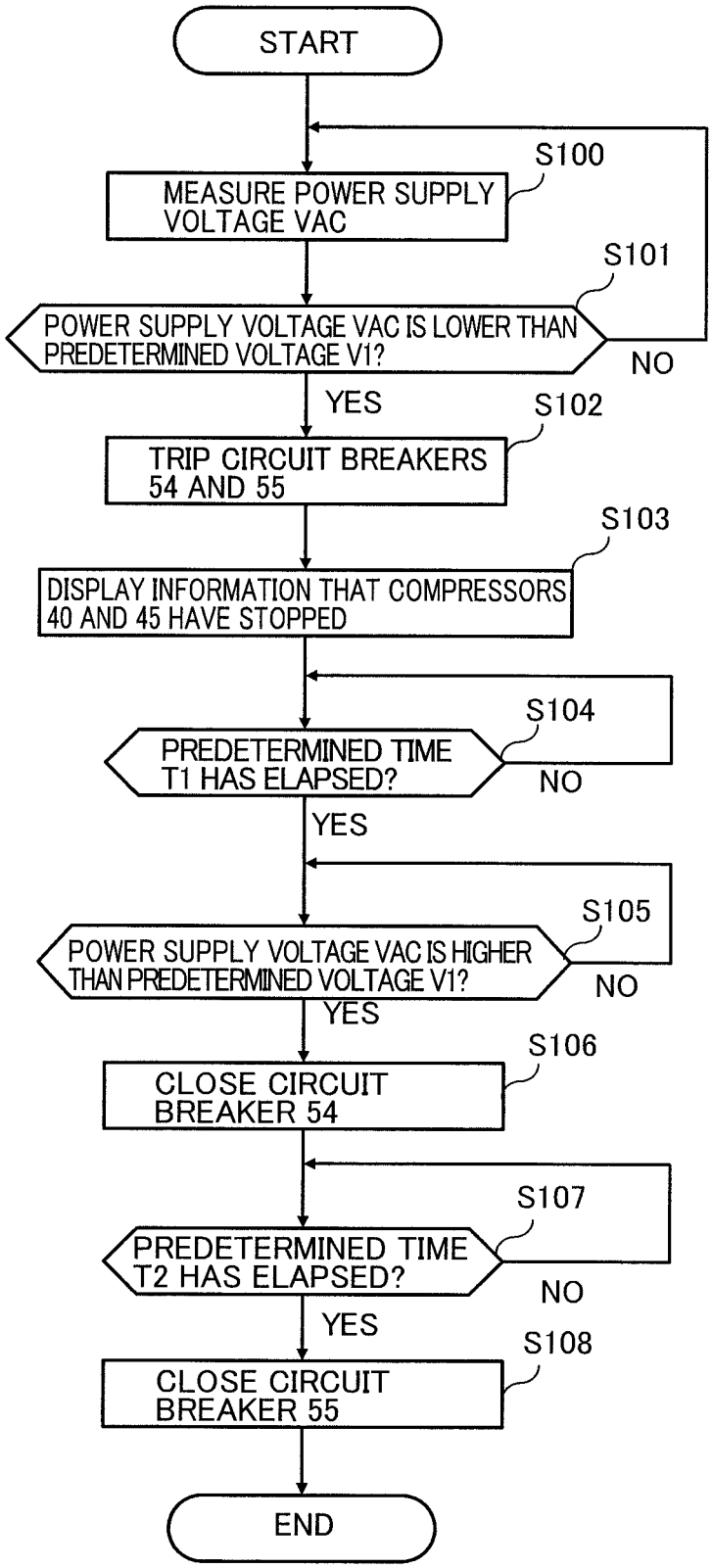
FIG. 3 is a flowchart illustrating an example of processing to be executed by a microcomputer 83.

A description will be given of one example of processing executed by functional blocks of the microcomputer 83 when the power supply voltage Vac drops, with reference to FIG. 3. It is assumed that the temperature inside the freezer 20 is approximately at the set temperature.

Firstly, the voltage measuring unit 101 acquires the output of the transformer 25 and measures the power supply voltage Vac (S100). The control unit 103 determines whether the power supply voltage Vac is lower than the predetermined voltage V1 (S101). If the power supply voltage Vac is higher than the predetermined voltage V1 (S101: NO), then processing S100 is repeated. On the other hand, if the power supply voltage Vac is lower than the predetermined voltage V1 (S101: YES), then the control unit 103 trips the circuit breakers 54 and 55 in order to prevent the currents IA and IB from reaching an overcurrent level in response to the drop in the power supply voltage Vac (S102). As a result, the currents IA and IB are interrupted and the compressors 40 and 45 stop working. The control unit 103 causes the display unit 82 to display the stop information indicating that the power supply voltage Vac has become lower than the predetermined voltage V1, thereby stopping the working of the compressors 40 and 45 (S103).

The control unit 103 determines whether the predetermined time T1 has elapsed since the tripping of the circuit breakers 54 and 55 based on results of timing by the timing unit 104 (S104). If the predetermined time T1 has elapsed since the tripping of the circuit breakers 54 and 55 (S104: YES), then the control unit 103 determines whether the power supply voltage Vac is higher than the predetermined voltage V1 (S105). That is to say, at processing S105, the control unit 103 determines whether the power supply voltage Vac has recovered.

If the control unit 103 determines that the power supply voltage Vac is higher than the predetermined voltage V1 (S105: YES), namely, if the control unit 103 determines that the power supply voltage Vac has recovered, then the control unit 103 closes the circuit breaker 54 to cause the compressor 40 to work (S106). The control unit 103 determines whether the predetermined time T2 has elapsed since the closing of the circuit breaker 54, based on the results of the timing by the timing unit 104 (S107). If the control unit 103 determines that the predetermined time T2 has elapsed since the closing of the circuit breaker 54 (S107: YES), then the control unit 103 closes the circuit breaker 55 to cause the compressor 45 to start working (S108).

With such processing being executed, the compressors 40 and 45 resume working after the recovery of the power supply voltage Vac.

<Example of Operation of Refrigerating Apparatus 10 when Power Supply Voltage Drops>

Figure 4:
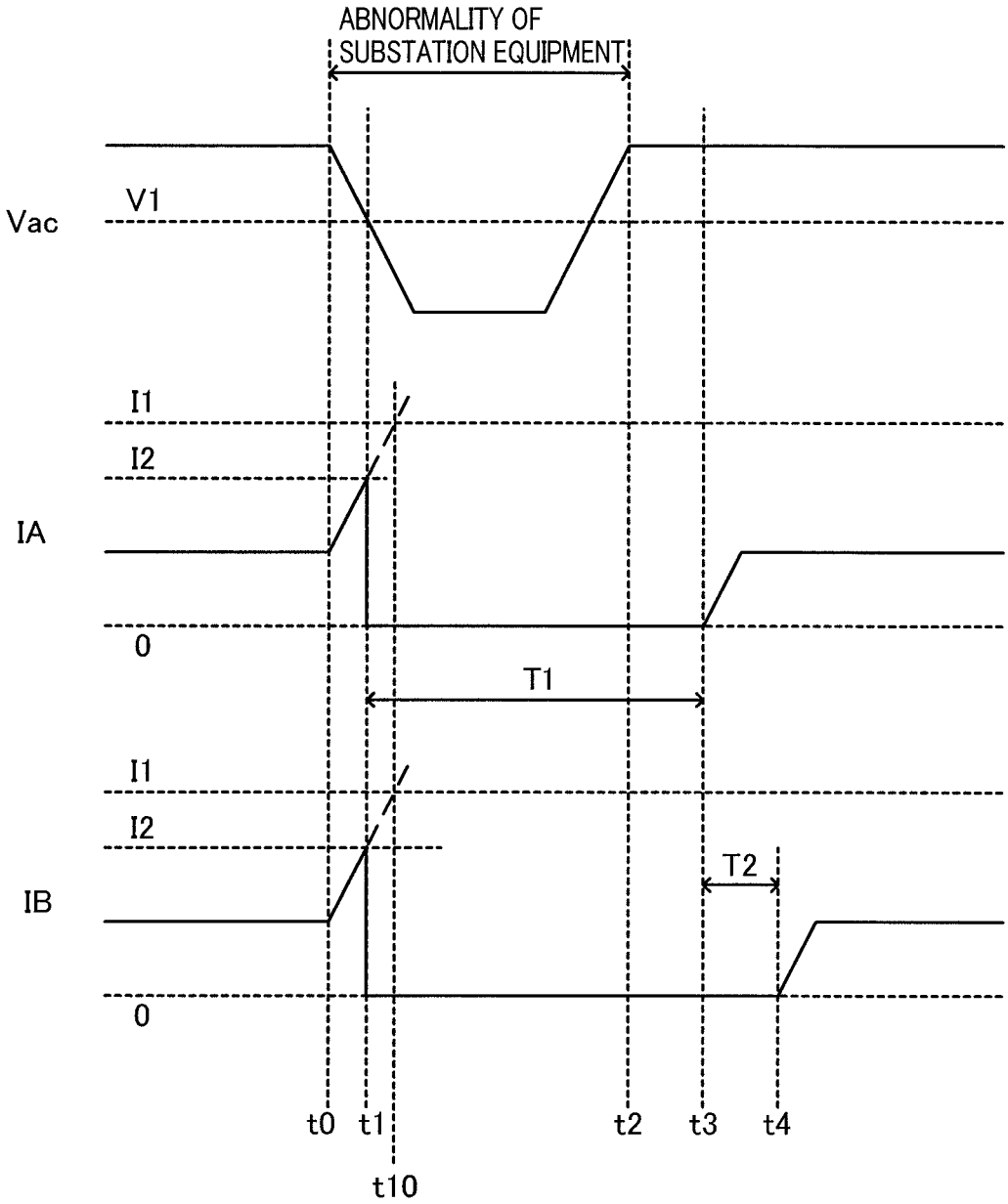
FIG. 4 is a diagram describing an operation of a refrigerating apparatus 10 when a voltage Vac of a commercial power supply temporarily drops.

A description will be given of one example of the operation of the refrigerating apparatus 10 when the power supply voltage Vac drops with reference to FIG. 4. It is assumed that both of the compressors 40 and 45 work and the temperature inside the freezer 20 is approximately at the set temperature. It is also assumed that an abnormality occurs in substation equipment thereby temporarily lowering the power supply voltage Vac between time t0 and time t2, for example.

When the power supply voltage Vac drops at time to, the current flowing through the motor (not shown) of each of the compressors 40 and 45 increases, and the currents IA and IB increase, for example. When the power supply voltage Vac becomes lower than the predetermined voltage V1 at time t1, the circuit breakers 54 and 55 are tripped (S102), and therefore the currents IA and IB reaches zero.

At time t3 when the predetermined time T1 has elapsed from time t1 (S104: YES), since the power supply voltage Vac is higher than the voltage V1 (S105: YES), the circuit breaker 54 is closed (S106). As a result, the current IA increases, thereby causing the compressor 40 to start working. Further, at time t4 when the predetermined time T2 has elapsed from time t3 (S107: YES), the circuit breaker 55 is closed (S108). Therefore, the current IB also increases, thereby causing the compressor 45 to start working. Thus, even when the power supply voltage Vac drops temporarily between time t0 and time t2, the compressors 40 and 45 restart working after the recovery of the power supply voltage Vac.

Incidentally, for example, when the circuit breakers 54 and 55 are controlled only based on the temperature inside the freezer 20, namely, when the circuit breakers 54 and 55 are not tripped despite the drop in the power supply voltage Vac, the currents IA and IB continue to increase even after time t1 as illustrated by a dotted line. Then, at time t10, since the currents IA and IB reach the predetermined current I1 indicative of an overcurrent, the circuit breakers 52 and 53 are tripped. The circuit breakers 52 and 53 are so-called manual-reset-type circuit breakers, and in such a case, the compressors 40 and 45 will not restart working automatically after the recovery of the power supply voltage Vac. On the other hand, in an embodiment of the present invention, the compressors 40 and 45 restarts working after the recovery of the power supply voltage Vac, thereby being able to suppress an increase in the temperature inside the freezer 20.

Hereinabove, a description has been given of the refrigerating apparatus 10 according to one embodiment of the present invention. When the power supply voltage Vac drops, the control apparatus 26 trips the circuit breaker 54 (third circuit breaker) before the circuit breaker 52 (first circuit breaker) that interrupts an overcurrent is tripped. When the power supply voltage Vac recovers, the circuit breaker 54 is closed. Thus, in an embodiment of the present invention, the manual-reset-type circuit breaker 52 is not tripped when the power supply voltage Vac drops, thereby being able to securely suppress an increase in the temperature inside the freezer 20.

The control unit 103 does not close the circuit breaker 54 until a time when the predetermined time T1, corresponding to a time period from a time when the circuit breaker 54 is tripped to a time when the pressure of the refrigerant on the suction side of the compressor 40 and the pressure of the refrigerant on the discharge side thereof reach equilibrium, has elapsed. Thus, the load of the compressor 40 at startup can be reduced.

The circuit breaker 54 is used also as a temperature-adjusting circuit breaker to adjust the temperature inside the freezer 20. Therefore, as compared with the case where the temperature-adjusting circuit breaker and the circuit breaker, that is tripped when the power supply voltage Vac drops, are provided separately, the number of components can be reduced.

The display unit 82 displays the stop information indicating that the compressors 40 and 45 have stopped working, when the power supply voltage Vac drops below the predetermined voltage V1. Thus, a user can grasp that the compressors 40 and 45 have stopped due to the drop in the power supply voltage Vac.

Even in the case where two compressors 40 and 45 are provided, as in the refrigerating apparatus 10, the increase in the temperature inside the freezer 20 can securely be suppressed.

If the compressors 40 and 45 are closed concurrently, a significantly large current is flown to the compressors 40 and 45 in a transient manner, which can have an adverse effect on power distribution equipment that supply the commercial power. In an embodiment of the present invention, the compressor 45 is started up after the predetermined time T2 has elapsed since the startup of the compressor 40, thereby being able to reduce the transient current generated when the compressors 40 and 45 are started up.

The refrigerating apparatus 10 is provided with two refrigerant circuits 21 and 22, however, a similar effect can be obtained even if only one refrigerant circuit (e.g., refrigerant circuit 21) is provided.

In general, there is variation in the time required for the pressure of the refrigerant on the suction side of the compressor 40 and the pressure of the refrigerant on the discharge side thereof to reach equilibrium. Therefore, the predetermined time T1 may be a predetermined multiple (e.g., 1.2 times) of an average time required for the pressure of the refrigerant on the suction side of the compressor 40 and the pressure of the refrigerant on the discharge side thereof to reach equilibrium.

It is assumed that both of the currents interrupted by the circuit breakers 52 and 53 are the predetermined current I1, however, even if the currents interrupted by these circuit breakers are different, an effect similar to that in an embodiment of the present invention can be obtained as long as such currents are greater than the predetermined current I2.

The above embodiments of the present invention are simply for facilitating the understanding of the present invention and are not in any way to be construed as limiting the present invention. The present invention may variously be changed or altered without departing from its spirit and encompass equivalents thereof.

What is claimed is:

1. A control apparatus configured to control a refrigerating apparatus including a compressor and a first circuit breaker, the first circuit breaker configured to interrupt a current flowing through the compressor when the current becomes greater than a predetermined current and configured to be closed in response to an operation by a user, the current flowing from a power supply through the compressor to cause the compressor to work, the control apparatus comprising:

a voltage measuring unit configured to measure a voltage of the power supply; and a control unit configured to trip a second circuit breaker disposed in series with the first circuit breaker so that the current from the power supply flowing through the compressor is interrupted, when the measured voltage of the power supply becomes lower than a predetermined voltage, and close the second circuit breaker after the voltage of the power supply becomes higher than the predetermined voltage, the predetermined current corresponding to a current greater than the current flowing through the compressor when the voltage of the power supply is equal to the predetermined voltage.

2. The control apparatus of claim 1, wherein the control unit is configured to close the second circuit breaker, when a predetermined time, corresponding to a time required for pressure of a refrigerant on a suction side of the compressor and pressure of the refrigerant on a discharge side thereof to reach equilibrium, has elapsed from tripping of the second circuit breaker as well as when the voltage of the power supply becomes greater than the predetermined voltage.

3. The control apparatus of claim 2, further comprising:

a temperature measuring unit configured to measure a temperature inside the refrigerating apparatus, wherein the control unit is configured to trip the second circuit breaker when the measured temperature inside the refrigerating apparatus reaches a first temperature, and to close the second circuit breaker when the temperature inside the refrigerating apparatus reaches a second temperature higher than the first temperature.

4. The control apparatus of claim 3, wherein the control unit is configured to display, on a display unit included in the refrigerating apparatus, information indicating that the compressor has stopped working, when the measured voltage of the power supply becomes lower than the predetermined voltage and the second circuit breaker is tripped.

5. A control apparatus configured to control a refrigerating apparatus including: first and second compressors; a first circuit breaker configured to interrupt a current flowing through the first compressor when the current becomes greater than a first current, and configured to be closed in response to an operation by a user, the current flowing from a power supply through the first compressor to cause the first and the second compressors to work; and a second circuit breaker configured to interrupt a current flowing through the second compressor when the current from the power supply flowing therethrough becomes greater than a second current, and configured to be closed in response to an operation by a user, the control apparatus comprising:

a voltage measuring unit configured to measure a voltage of the power supply;

a first control unit configured to trip a third circuit breaker disposed in series with the first circuit breaker so that the current from the power supply flowing through the first compressor is interrupted, when the measured voltage of the power supply becomes lower than a predetermined voltage, and close the third circuit breaker after the voltage of the power supply becomes higher than the predetermined voltage; and a second control unit configured to trip a fourth circuit breaker disposed in series with the second circuit breaker so that the current from the power supply flowing through the second compressor is interrupted when the measured voltage of the power supply becomes lower than the predetermined voltage and close the fourth circuit breaker after the voltage of the power supply becomes higher than the predetermined voltage, the first current corresponding to a current greater than the current flowing through the first compressor when the voltage of the power supply is equal to the predetermined voltage, and wherein the second current corresponding to a current greater than the current flowing through the second compressor when the voltage of the power supply is equal to the predetermined voltage.

6. The control apparatus of claim 5, wherein the first control unit is configured to close the third circuit breaker, when a first time, corresponding to a time required for pressure of a refrigerant on a suction side of the compressor and pressure of the refrigerant on a discharge side thereof to reach equilibrium, has elapsed from tripping of the third circuit breaker, as well as when the voltage of the power supply becomes greater than the predetermined voltage, and wherein the second control unit is configured to close the fourth circuit breaker in a tripped state after a second time has elapsed from closing of the third circuit breaker in the tripped state.

7. A refrigerating apparatus comprising:

a compressor;

a first circuit breaker configured to interrupt a current flowing through the compressor when the current becomes greater than a predetermined current, and configured to be closed in response to an operation by a user, the current flowing from a power supply through the compressor to cause the compressor to work;

a second circuit breaker disposed in series with the first circuit breaker;

a voltage measuring unit configured to measure a voltage of the power supply; and a control apparatus configured to trip the second circuit breaker so that the current from the power supply flowing through the compressor is interrupted, when the measured voltage of the power supply becomes lower than a predetermined voltage, and close the second circuit breaker after the voltage of the power supply becomes higher than the predetermined voltage, the predetermined current corresponding to a current greater than the current flowing through the compressor when the voltage of the power supply is equal to the predetermined voltage.

* * * * *